US005544925A

United States Patent [19]

Ikeda

[11] Patent Number: 5,544,925

[45] Date of Patent: Aug. 13, 1996

[54] SPRING MOUNTING DEVICE FOR AUTOMOTIVE DOOR LOCK APPARATUS

[75] Inventor: Takao Ikeda, Utsunomiya, Japan

[73] Assignee: Mitsui Kinzoku Kogyo Kabushiki Kaisha, Tokyo, Japan

[21] Appl. No.: 553,088

[22] Filed: Nov. 3, 1995

Related U.S. Application Data

[63] Continuation of Ser. No. 148,919, Nov. 5, 1993, abandoned.

[30] Foreign Application Priority Data

| | | | |
|---|---|---|---|
| Nov. 9, 1992 | [JP] | Japan | 4-323597 |
| Nov. 26, 1992 | [JP] | Japan | 4-339725 |
| Nov. 30, 1992 | [JP] | Japan | 4-343167 |

[51] Int. Cl.[6] ..... E05C 3/16

[52] U.S. Cl. ..... 292/216; 292/337; 292/341.12; 292/DIG. 53; 292/DIG. 56; 74/576; 74/577 R

[58] Field of Search ..... 292/198, 341.12, 292/341.13, DIG. 61, DIG. 56, DIG. 38, DIG. 53, 337, 219, DIG. 23, 216; 74/576, 577 R

[56] References Cited

U.S. PATENT DOCUMENTS

| | | | |
|---|---|---|---|
| 2,153,387 | 4/1939 | Newman | 292/DIG. 61 X |
| 2,310,550 | 2/1943 | Roethel | 292/341.12 |
| 3,811,719 | 5/1974 | McBurnie et al. | 292/219 X |
| 4,358,141 | 11/1982 | Hamada . | |
| 4,538,845 | 8/1985 | Yamada . | |
| 4,756,563 | 6/1988 | Garwood et al. . | |
| 5,020,838 | 6/1991 | Fukumoto | 292/216 X |
| 5,035,453 | 7/1991 | Fukumoto et al. | 292/216 X |
| 5,106,134 | 4/1992 | Thau | 292/337 X |
| 5,273,324 | 12/1993 | Kobayashi | 292/216 X |

FOREIGN PATENT DOCUMENTS

| | | | |
|---|---|---|---|
| 1421293 | 1/1976 | United Kingdom | 292/341.12 |

*Primary Examiner*—Rodney M. Lindsey
*Attorney, Agent, or Firm*—Browdy and Neimark

[57] ABSTRACT

An automotive door lock apparatus comprises a lock body having a latch for engaging with a striker and a ratchet for preventing the latch from pivoting in reverse direction, the lock body defining a cavity for receiving the latch and the ratchet, a spring arranged between the wall portion of the cavity and the tip end of the ratchet for resiliently contacting the ratchet to the latch, a cover plate mounted on the body for covering the cavity and preventing the spring from jumping out, and holding portions formed in the wall portion and the tip end. The holding portions having slightly smaller diameter than the diameter of the spring for temporarily holding the end of the spring.

13 Claims, 8 Drawing Sheets

SPRING MOUNTING DEVICE FOR AUTOMOTIVE DOOR LOCK APPARATUS

This application is a continuation of application Ser. No. 08/148,919, filed Nov. 5, 1993, now abandoned.

BACKGROUND OF THE INVENTION

1. Field of the Invention

The present invention relates to a spring mounting device for an automotive door lock apparatus.

2. Description of the Related Art

Typically, the conventional door lock apparatus of an automotive vehicle includes a lock body accommodating a latch for engaging with a striker rigidly secured on a vehicular body and a ratchet for preventing the latch from pivoting in a reverse or releasing direction. The ratchet is normally biased by means of a spring so that the ratchet teeth constantly contact with the outer periphery of the latch.

As the spring for biasing the ratchet, a torsion spring type one (e.g. U.S. Pat. No. 4,756,563) wound around a rotational center shaft of the ratchet and a compression coil spring type one (e.g. U.S. Pat. No. 4,358,141) disposed between the tip end of the ratchet and the peripheral wall of the body have been available. The present invention is intended to facilitate mounting of the latter compression coil spring.

FIGS. 21 and 22 are explanatory illustrations showing process steps for mounting the compression coil spring A. As can be seen, in the prior art, the compression spring A is set in a receptacle space E defined between the tip end C of the ratchet B and the peripheral wall D of the lock body with compression in a given magnitude. Then, a cover plate F is mounted as shown in FIG. 22 while manually maintaining the spring A within space E so that it should not jump out. However, since the spring disposed within the receptacle space E can easily jumps out unless sufficient attention is paid, the installer must be very careful and use two hands when assembling a lock assembly.

SUMMARY OF THE INVENTION

Therefore, it is an object of the present invention to facilitate mounting of the coil spring and whereby to contribute for improving efficiency in assembling operation.

BRIEF DESCRIPTION OF THE DRAWINGS

Other features and advantages of the invention will become apparent from the following description taken in connection with the accompanying drawings.

DESCRIPTION OF THE PREFERRED EMBODIMENT

Figure 1:
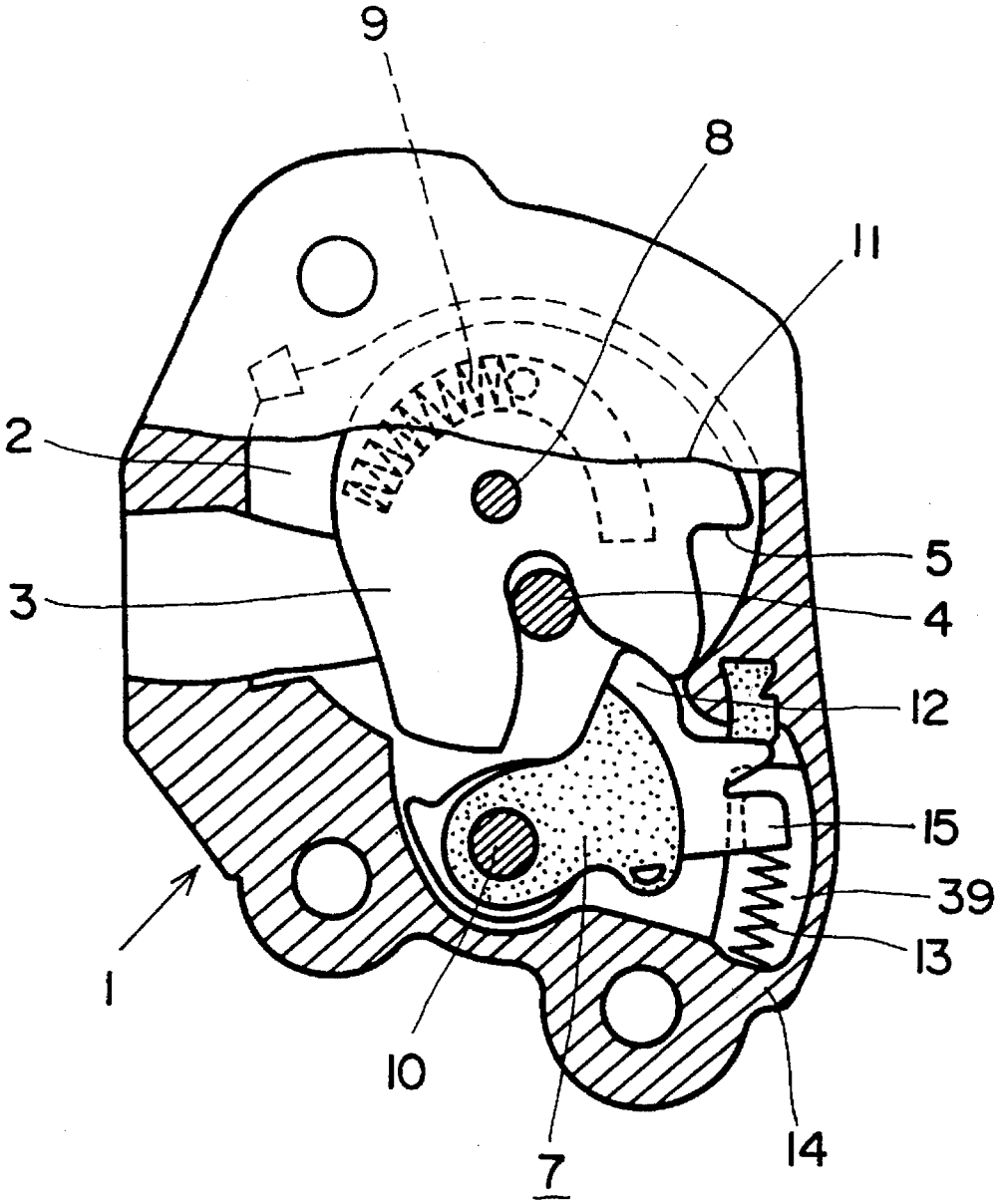
FIG. 1 is a front elevation of a lock body, in which a cover plate is illustrated in partially cut out form.
Figure 2:
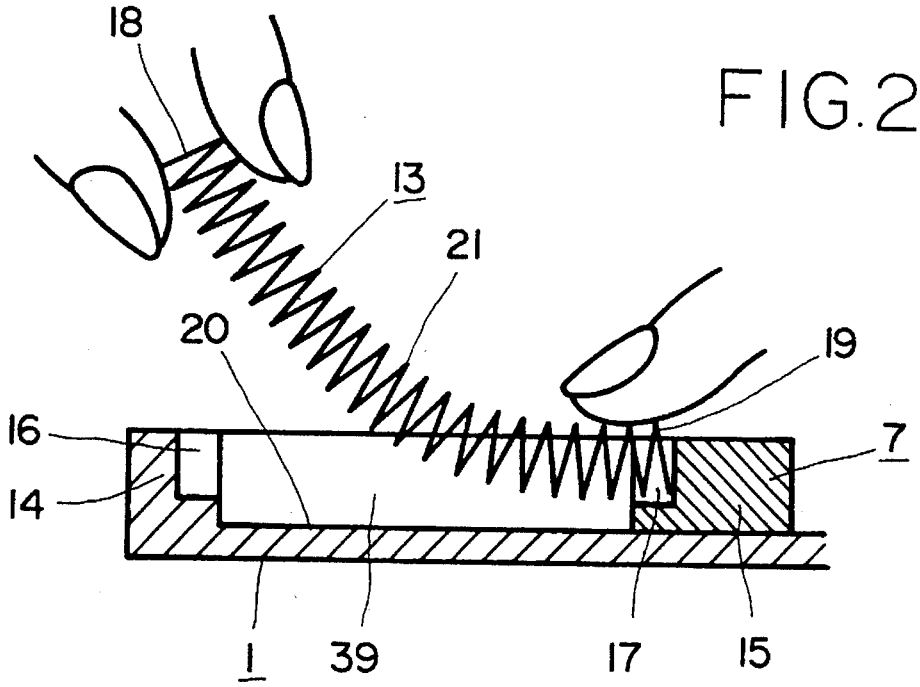
FIGS. 2 to 4 are sections showing an assembling process in the first embodiment.

In the illustrative embodiments of the invention as illustrated on the drawings, a synthetic resin lock body 1 of a door lock apparatus defines a recessed cavity 2 at the front surface side for receiving therein a latch 3 for engaging with a striker 4, and a ratchet 7 for engaging with first and second engaging portions 5 and 6 of the latch 3. The latch 3 is pivotally supported on a shaft 8 and is biased in a clockwise direction in FIG. 1 by means of a spring. The ratchet 7 is rotatably supported on a shaft 10. At the front surface side of the body 1, a metallic cover plate 11 for enclosing the recessed cavity 2 is mounted.

The ratchet 7 is biased in counterclockwise direction in FIG. 1 by means of a compression coil spring 13. Ratchet tooth 12 of the ratchet rest on the outer periphery of the ratchet 7. The spring 13 is set in a receptacle space 39 defined between the peripheral wall portion 14 of the recessed cavity 2 and the tip end 15 of the ratchet 7. When the recessed cavity 2 is enclosed by the cover plate 11, the spring 13 can be held with avoiding possibility of jumping out of the receptacle space. The present invention is to improve the efficiency of assembling the cover plate 11 to the body after setting the spring 13 into the receptacle space 39. The invention will be discussed more fully hereinafter in terms of typical embodiments.

Figure 3:
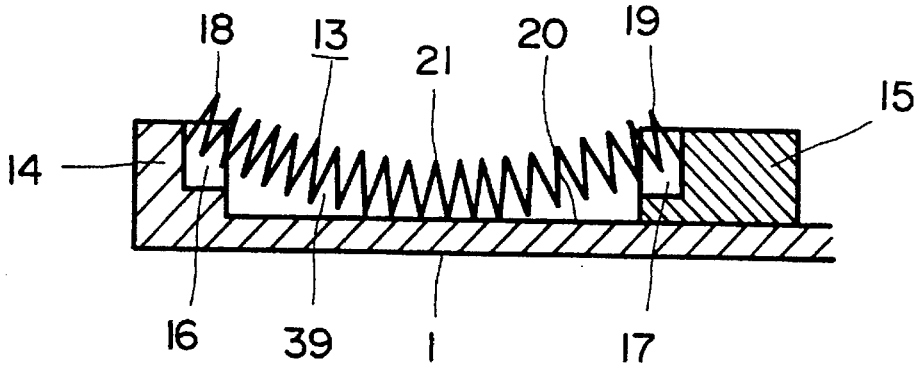
Figure 4:
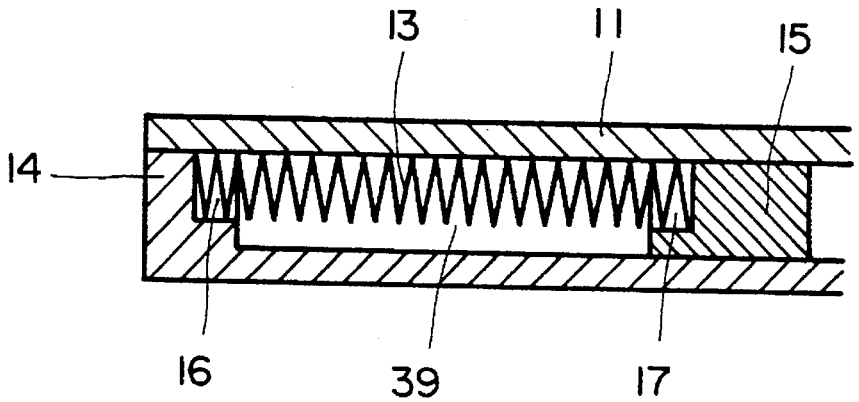
Figure 5:
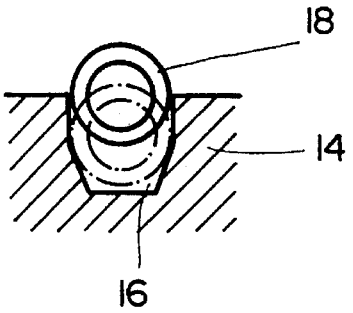
FIG. 5 is a section of a holding portion in the first embodiment.

The first embodiment is shown in FIGS. 2 to 5. The peripheral wall portion 14 of the recessed cavity and the tip end 15 of the ratchet forming both sides of the receptacle space 39 are respectively provided holding portions 16 and 17. As shown in FIG. 5, the holding portions 16 and 17 are formed in forms of substantially U-shaped grooves progressively narrowing toward the bottom. The diameter at the opening mouth or the tip end is equal to or slightly smaller than the diameter of the spring 13. When ends 18 and 19 of the spring 13 are inserted into respectively corresponding holding portions 16 and 17, both ends 18 and 19 of the spring 3 can be temporarily held. On the other hand, the holding portions 16 and 17 are formed at an elevation slightly higher than the bottom portion 20 of the receptacle space 39 so that the spring 13 can be held in moderate arc shaped configuration as depressed by the bottom portion 20 at the intermediate portion 21, as shown in FIG. 3, when the intermediate portion 21 of the spring is depressed downwardly after inserting into the holding portions 16 and 17. At the condition of FIG. 3, the spring 13 is substantially held from jumping out even when it is released from manual gripping. Then, the worker may use the hand which become free for mounting the cover plate 11 to the body 1. Then, by the cover plate 11, the ends 18 and 19 are easily depressed into the receptacle space 39 to complete assembling operation.

It should be noted that although it is best to provide the holding portions 16 and 17 for both of the wall portion 14 and the tip end 15, the assembling operation may be significantly facilitated even when the holding portion is formed only one of the wall portion 14 and the tip end 15.

Figure 6:
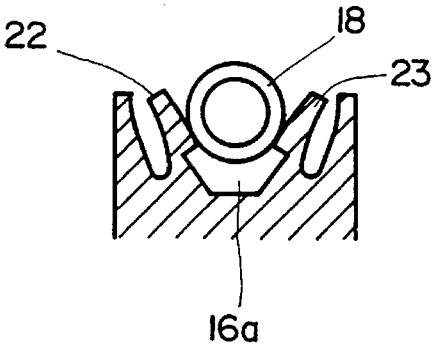
FIG. 6 is a section of an improved holding portion.
Figure 7:
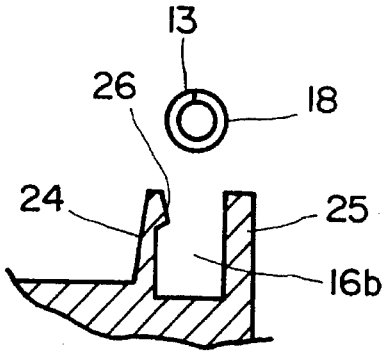
FIGS. 7 to 9 are sections of a further improved holding portion.
Figure 8:
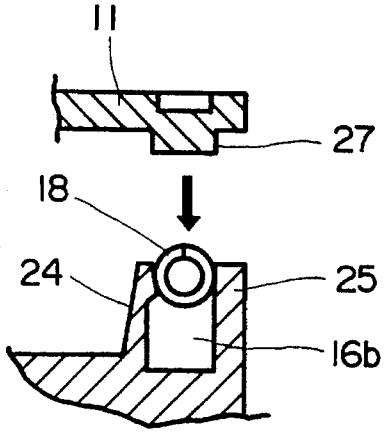
Figure 9:
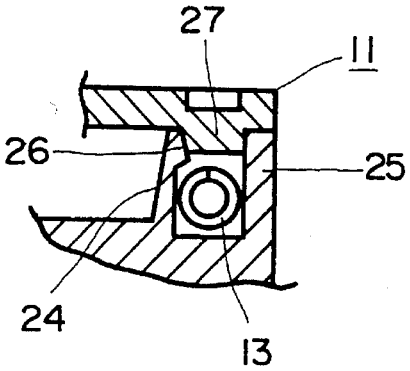
Figure 10:
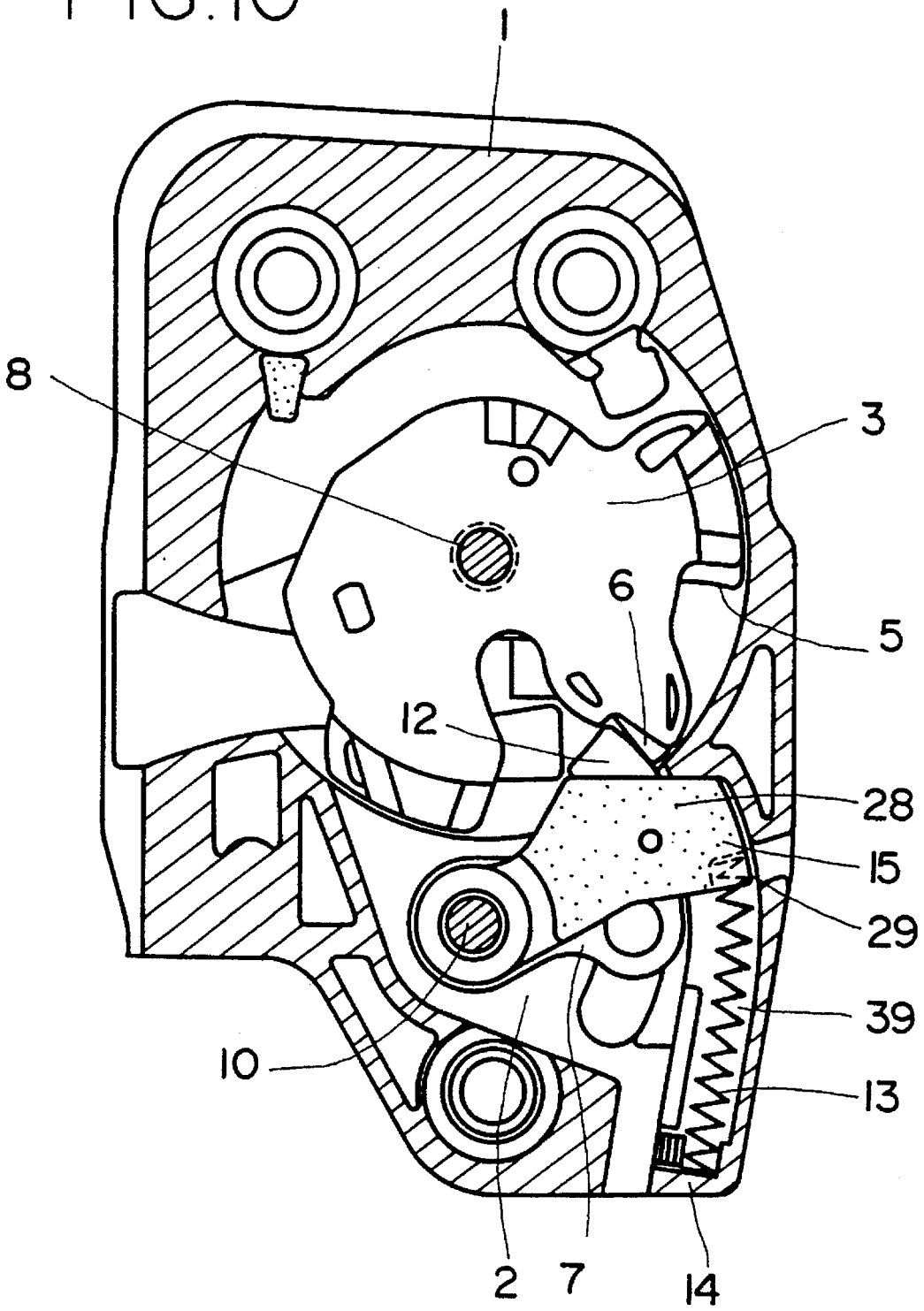
FIG. 10 is a front elevation of the second embodiment of a lock body.
Figure 11:
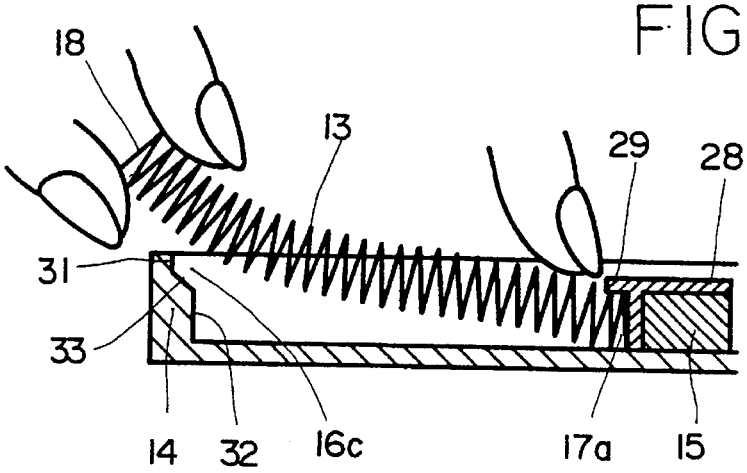
FIGS. 11 to 14 are sections showing an assembling process in the second embodiment.
Figure 12:
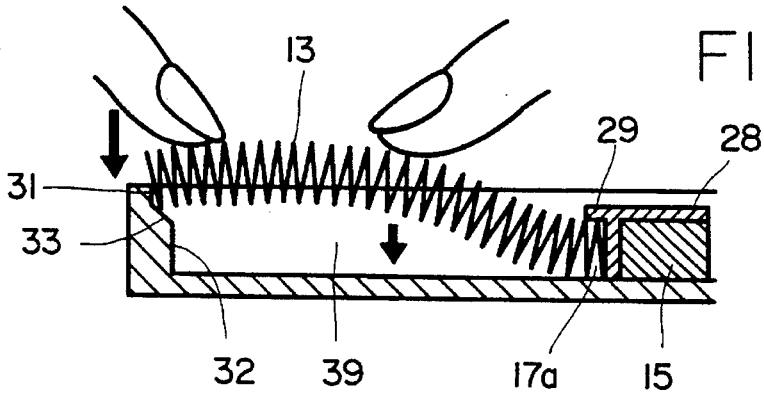

FIGS. 6 to 9 show an improvement for the foregoing holding portion. In FIG. 6, a holding portion **16*a* is formed with a pair of legs 22 and 23 in bifurcated form. The legs 22 and 23 are provided resiliently deformably characteristics so that they may deflect away from each other when the spring 13 is inserted. A holding portion 16***b* in FIGS. 7 to 9 also has bifurcated legs 24 and 25. However, in this modification, only one leg 24 is provided sufficient resiliently deformable characteristics. On the inner side of the tip end of the leg 24, an inwardly projecting hook 26 is provided. The distance between the hook 26 and the leg 25 is smaller than the diameter of the spring 13. On the other hand, the distance of the legs 24 and 25 at the bottom portion of the holding portion 16*b* is greater than the diameter of the spring 13. In the shown improvement, when the cover plate 11 is mounted on the body 1 after temporarily holding the end 18 of the spring between the hook 26 and the leg 25, a bulged portion 27 of the cover plate 11 pushes the end of the spring into the wider bottom portion of the holding portion 16*b*. The construction of the holding portions shown in FIGS. 6 and 7 are suitable to be formed in the wall portion 14 of the body 1.

Next, discussion will be given for the second embodiment. Since the conventionally known ratchet is made of a metal in order to certainly provide sufficient strength, uncomfortable noise can be generated when the ratchet and the metallic cover plate are contact to each other. In order to suppress generation of the noise, it has been known to attach a synthetic resin silencer for the ratchet, such as that disclosed in U.S. Pat. No. 4,538,845. The second embodiment prevents the coil spring from jumping out utilizing this silencer.

The silencer 28, according to the present invention, is mounted to cover at least the upper surface of the tip end 15 of the ratchet 7, as shown in FIGS. 10 to 14. The silencer 28 integrally formed with a holding piece 29 extending toward the wall portion 14 of the body to define a space therebelow, which space serves as a holding portion 17*a*. In this embodiment, since the metallic ratchet 7 can be used as is without requiring modification thereof, an economical advantage can be attained. On the other hand, when a groove form holding portion is directly formed in the metallic ratchet, attention should be paid so as not to lower the strength of the ratchet. However, the shown embodiment is free from such necessity.

Figure 13:
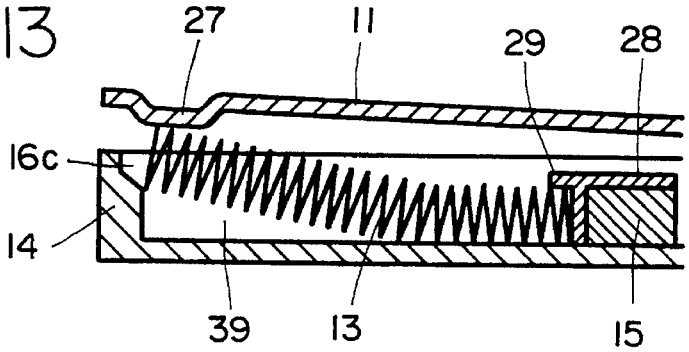
Figure 14:
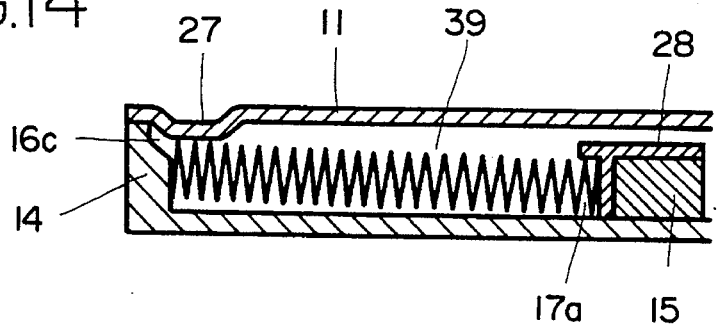

Also, in the embodiment of FIGS. 11 to 14, an improvement is also made for the holding portion in the wall portion 14. As can be clear from the drawings, a holding portion 16*c* is formed with two substantially vertical walls 31, 32 and a tilted wall 33 connecting therebetween. The upper first wall 31 is formed at distal position to the holding portion 17*a* of the ratchet 7, and the lower second wall 32 is formed at proximal position thereto. The end 18 of the spring 13 is temporarily held on the first wall 31 and subsequently depressed downwardly by the bulged portion 27 of the cover plate 11, as shown in FIGS. 13 and 14. In this construction, the spring 13 can be temporarily held with reduced spring force by the extended length of the receptacle space 39.

Figure 15:
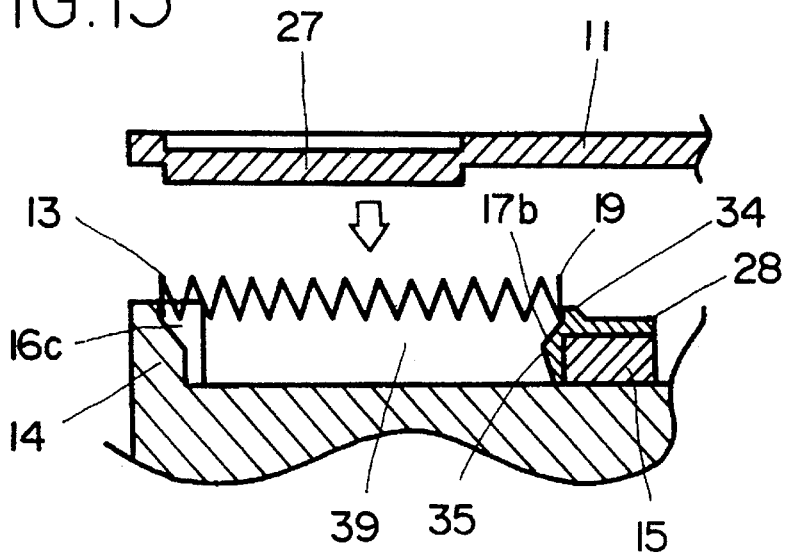
FIGS. 15 to 17 are sections of the third embodiment.
Figure 16:
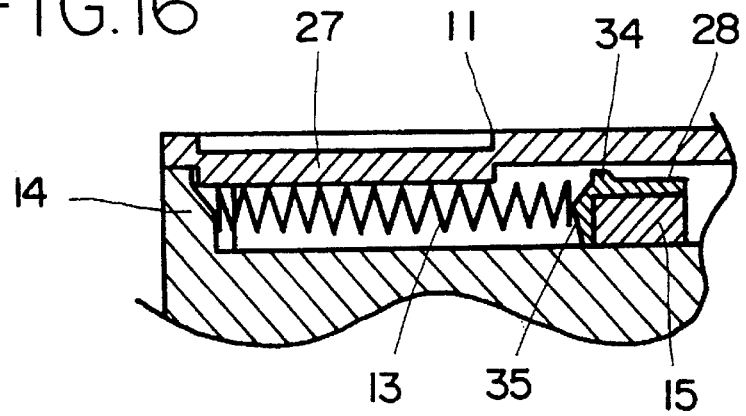
Figure 17:
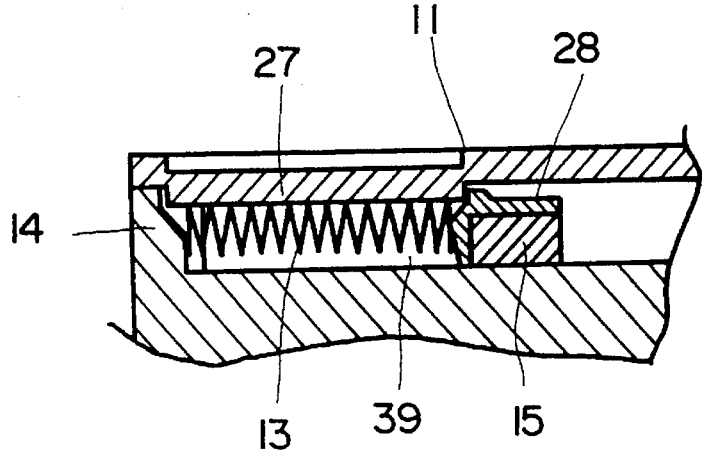

FIGS. 15 to 17 show another holding portion 17*b* utilizing the silencer 28. The silencer 28 is formed with a horn like projection 34 which extends toward the cover plate 11. The silencer 28 is also formed with an engaging projection 35 projecting below the horn like projection toward the holding portion 16*c* of the body 1 for engaging with the central portion of the spring 13. With this construction, the end 19 of the spring 13 is temporarily held by the horn like projection 34 and subsequently depressed by the bulged portion 27 of the cover plate 11 to engage with the engaging projection 35.

Figure 18:
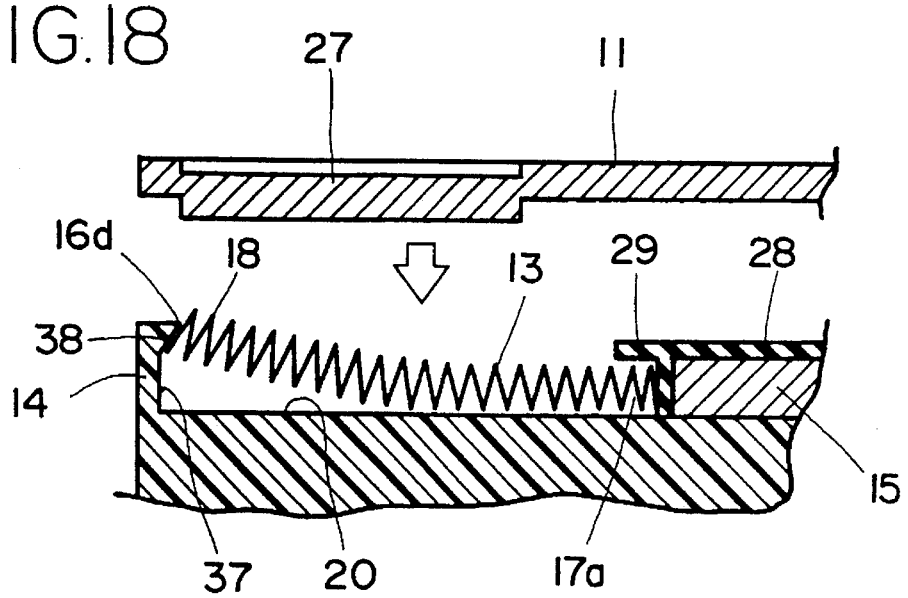
FIGS. 18 to 19 are sections of the fourth embodiment.
Figure 19:
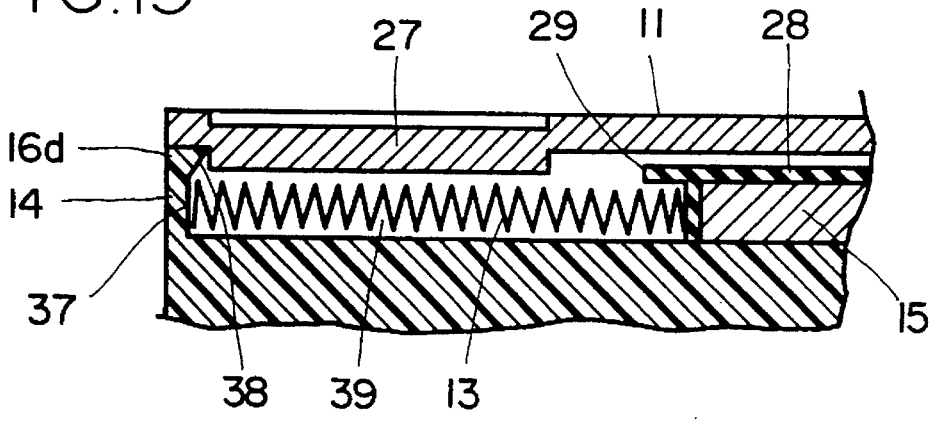
Figure 20:
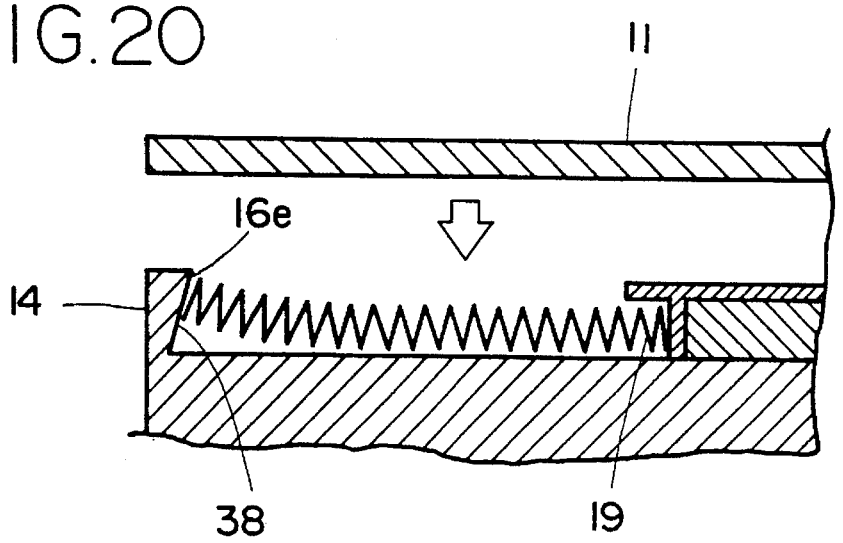
FIG. 20 is a section of an improvement of the fourth embodiment.
Figure 21:
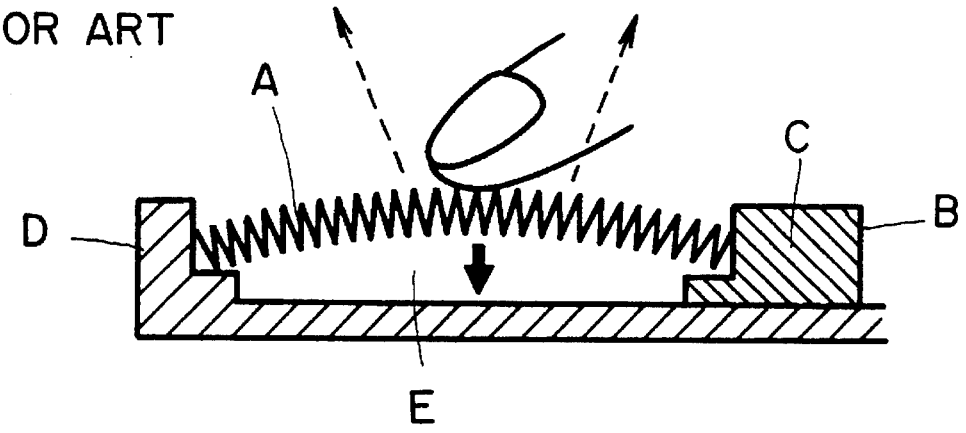
FIG. 21 PRIOR ART
FIGS. 21 and 22 are illustration showing prior art.
Figure 22:
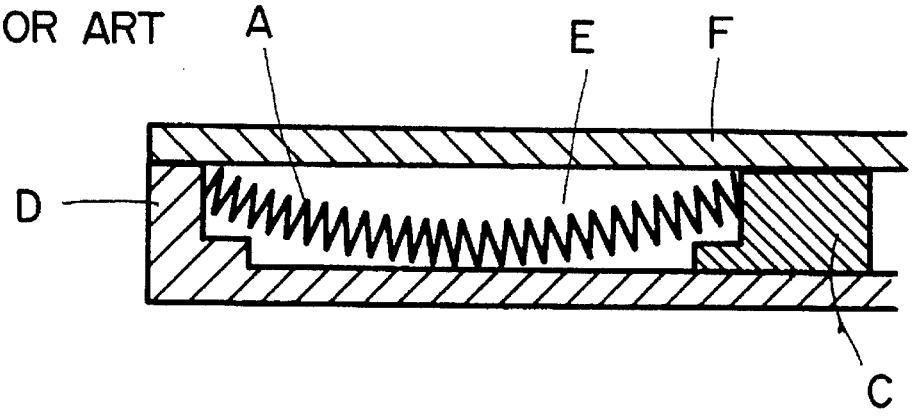
FIG. 22 PRIOR ART

In FIGS. 18 and 19, a further holding portion 16*d* is illustrated. The holding portion 16*d* is formed with a lower substantially vertical wall 37 and an upper overhanging wall 38. The overhanging wall 38 is tilted toward the ratchet 7. Therefore, when the end of the spring is temporarily held by the overhanging wall 38, the spring is curved downwardly to easily prevent the spring from jumping out. FIG. 20 illustratively shows a holding portion 16*e* formed with only overhanging walls 38.

As set forth above, according to the present invention, since the spring 13 can be quite easily held in the receptacle space in temporary manner, so that the cover plate 11 can be mounted with hand which can be made free to make assembling operation easier. It should be obvious that the present invention is more effective when the door lock arrangement is assembled by means of machines.

On the other hand, the construction of the holding portion of the body 1 and the construction of the holding portion of the ratchet 7 may be combined arbitrary.

What is claimed is:

1. An automotive door lock apparatus comprising:

a lock body having a latch for engaging with a striker, a ratchet engageable with the latch for maintaining the engagement between the latch and the striker, and a spring for resiliently engaging a pawl of the ratchet against the latch, said lock body defining a first cavity for receiving the latch and the ratchet;

a first holding portion formed in the lock body for temporarily holding one end of the spring;

a synthetic resin silencer to be attached to the ratchet for suppressing noise thereof, said silencer has a second holding portion for temporarily holding the other end of the spring;

an elongated second cavity formed in the lock body between the first and second holding portions for receiving the spring; said second cavity being shorter than the spring before compression;

a cover plate mounted on the lock body for covering the first and second cavities and preventing the spring from jumping out of the second cavity when engaged in said second cavity;

said second holding portion having a holding piece extending toward the first holding portion and a holding space, defined below the holding piece, into which the other end of the spring is inserted.

2. An apparatus as set forth in claim 1, wherein said first holding portion has a smaller diameter than the diameter of said spring.

3. An apparatus as set forth in claim 1, wherein said first holding portion is a substantially U-shaped groove, a bottom of which is gradually narrowed.

4. An apparatus as set forth in claim 1, wherein said first holding portion has an overhanging wall for holding said spring in a bridge like state in which a medium portion of the spring is in contact with a bottom of said second cavity.

5. An apparatus as set forth in claim 4, wherein said cover plate has a bulged portion for depressing the one end of said spring engaging with said overhanging wall toward said bottom.

6. An apparatus as set forth in claim 1, wherein said first holding portion is formed into a fork-like configuration to resiliently expand an entrance portion of the first holding portion.

7. An apparatus as set forth in claim 6, wherein a pair of legs of said first holding portion have a distance at said entrance portion narrower than the diameter of said spring and a distance at a bottom of the first holding portion wider than the distance at said entrance portion.

8. An apparatus as set forth in claim 6, wherein said cover plate has a bulged portion for depressing the one end of said spring engaging with said entrance portion toward a bottom of said second cavity.

9. An apparatus as set forth in claim 1, wherein said first holding portion has a first wall remote from a tip end of said ratchet for temporarily holding the one end of said spring and a second wall proximal to the tip end for final holding the one end of the spring.

10. An apparatus as set forth in claim 9, wherein said first and second walls are connected by a tilted guide wall.

11. An apparatus as set forth in claim 9, wherein said cover plate has a bulged portion for depressing the one end of said spring engaging with said first wall toward said second wall.

12. An automotive door lock apparatus comprising:

a lock body having a latch for engaging with a striker and a ratchet for preventing said latch from pivoting to an unbiased position, said lock body defining a cavity for receiving said latch and said ratchet;

a spring arranged between a wall portion of said cavity and a tip end of said ratchet for resiliently engaging a tooth of said ratchet against said latch;

wherein a width of a first U-shaped holding portion on said wall portion and a width of a second U-shaped holding portion on said tip end are smaller than the diameter of said spring to permit the spring to be temporarily held within said first U-shaped holding portion and said second U-shaped holding portion; and, a cover plate mounted on said body for covering said cavity and preventing said spring from jumping out of said cavity.

13. An automotive door lock apparatus comprising:

a lock body having a latch for engaging with a striker and a ratchet for preventing said latch from pivoting to an unbiased position, said lock body defining a cavity for receiving said latch and said ratchet;

a spring arranged between a wall portion of said cavity and a tip end of said ratchet for resiliently engaging a tooth of said ratchet against said latch;

wherein a width of a first U-shaped holding portion on said wall portion and a width of a second U-shaped holding portion on said tip end are smaller than the diameter of said spring to permit the spring to be temporarily held within said first U-shaped holding portion and said second U-shaped holding portion;

a cover plate mounted on said body for covering said cavity and preventing said spring from jumping out; and a synthetic resin silencer to be attached to said ratchet for suppressing noise; and the second holding portion formed integrally with said silencer.

* * * * *